US007976943B2

(12) United States Patent
Chitrangad

(10) Patent No.: US 7,976,943 B2
(45) Date of Patent: Jul. 12, 2011

(54) HIGH LINEAR DENSITY, HIGH MODULUS, HIGH TENACITY YARNS AND METHODS FOR MAKING THE YARNS

(75) Inventor: Bhatnagar Chitrangad, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 754 days.

(21) Appl. No.: 11/973,527

(22) Filed: Oct. 9, 2007

(65) Prior Publication Data

US 2009/0092830 A1 Apr. 9, 2009

(51) Int. Cl.
*D02G 3/00* (2006.01)
*D01F 6/00* (2006.01)
*D01F 6/04* (2006.01)

(52) U.S. Cl. ..... 428/364; 428/401; 428/36.2; 264/184; 264/203; 264/103

(58) Field of Classification Search ..... None
See application file for complete search history.

(56) References Cited

U.S. PATENT DOCUMENTS

| | | | | |
|---|---|---|---|---|
| 3,094,511 A | | 6/1963 | Hill, Jr. et al. | |
| 3,354,127 A | | 11/1967 | Hill, Jr. et al. | |
| 3,673,143 A | | 6/1972 | Bair et al. | |
| 3,819,587 A | | 6/1974 | Kwoleck | |
| 3,869,429 A | | 3/1975 | Blades | |
| 3,869,430 A | * | 3/1975 | Blades | 528/348 |
| 4,172,938 A | | 10/1979 | Mera et al. | |
| 4,298,565 A | | 11/1981 | Yang | |
| 4,340,559 A | | 7/1982 | Yang | |
| 5,001,219 A | | 3/1991 | Chern et al. | |
| 5,151,142 A | * | 9/1992 | Imai et al. | 152/565 |
| 5,175,239 A | | 12/1992 | Gauntt et al. | |
| 5,478,648 A | | 12/1995 | Stein et al. | |
| 5,674,615 A | | 10/1997 | Neuert et al. | |

FOREIGN PATENT DOCUMENTS

| | | |
|---|---|---|
| EP | 0 423 703 A2 | 4/1991 |
| WO | WO 95/04174 | 2/1995 |
| WO | WO 2007/004851 A1 | 1/2007 |

OTHER PUBLICATIONS

Leroy E. Alexander, "X-Ray Diffraction Methods in Polymer Science", Wiley Interscience (1969) Chapter 4, p. 264.
W,B, Black et al., Man-Made Fibers, Science and Technology, vol. 2, Section titled "Fiber-Forming Aromatic Polyamides", p. 297, Interscience Publishers (1968).
H. H. Yang, Kevlar Aramid Fiber, Kevlar Aramid Fiber, Chichester, Wiley & Sons, GB, pp. 28/29, XP002098773, p. 28, paragraph 2.5; table 2.2.

* cited by examiner

*Primary Examiner* — D. Lawrence Tarazano
*Assistant Examiner* — Nicole T Gugliotta

(57) ABSTRACT

The present invention relates to a yarn, comprising (a) a plurality of fibers having an orientation angle of no more than 8.0 degrees and made of a para-aramid having an inherent viscosity of 5.2 to 6.2 dl/g, (b) a linear density of at least 2666 dtex (2400 denier), (c) a modulus of at least 810 grams per dtex (900 grams per denier), and (d) a tenacity of at least 18 grams per dtex (20 grams per denier). The invention further relates to methods of making such yarn.

21 Claims, 2 Drawing Sheets

HIGH LINEAR DENSITY, HIGH MODULUS, HIGH TENACITY YARNS AND METHODS FOR MAKING THE YARNS

BACKGROUND OF THE INVENTION

1. Field of the Invention

This invention relates to high linear density, high modulus, high tenacity yarns and methods of making the yarns.

2. Description of Related Art

Para-aramid yarns have been long known for their light weight, high denier, high strength and high modulus. They have been used in a great number of applications requiring various combinations of para-aramid yarn properties. There is a strong demand and need for yarns having still higher denier, modulus and/or tenacity combinations for use in still more demanding applications.

U.S. Pat. No. 5,001,219 discloses high modulus, high tenacity para-aramid yarns and a process for making the yarns. However, it does not disclose how to make para-aramid yarns with a linear density of at least 2666 dtex and a modulus of at least 810 grams per dtex while maintaining tenacity of at least 18 grams per dtex.

It is an objective of this invention to provide a high denier yarn with a high modulus and a high tenacity capable of being used in more demanding applications than prior art yarns.

It is a further objective to make the yarn in an on-line commercial yarn manufacturing process.

These and other objects of the invention will be clear from the following description.

BRIEF SUMMARY OF THE INVENTION

The invention relates to a yarn, comprising: (a) a plurality of fibers having an orientation angle of no more than 8.0 degrees and made of para-aramid having an inherent viscosity of 5.2 to 6.2 dl/g, (b) a linear density of at least 2666 dtex (2400 denier), (c) a modulus of at least 810 grams per dtex (900 grams per denier), and (d) a tenacity of at least 18 grams per dtex (20 grams per denier).

The invention further relates to a continuous process for making a para-aramid yarn having a linear density of at least 2666 dtex (2400 denier), a modulus of at least 810 grams per dtex (900 grams per denier) and a tenacity of at least 18 grams per dtex (20 grams per denier), comprising:

extruding an anisotropic solution of para-aramid in a solvent-through a spinneret having a plurality of holes forming a plurality of fibers, passing the fibers through a gas and then a coagulating liquid, combining the fibers into a yarn, washing the yarn with a washing solution, removing some of the washing solution from the surface of the yarn, treating the yarn by heating the yarn from 120° C. to 260° C. under a tension of 0.90 to 2.25 grams per dtex (1.00 to 2.50 grams per denier) for a first heating time of 1.6 to 6.0 seconds, and after the first treating step, treating the heated yarn from 300° C. to 400° C. under a tension of 2.25 to 4.50 grams per dtex (2.50 to 5.00 grams per denier) for a second heating time of 0.2 to 5.0 seconds, cooling the yarn to a temperature of 125 to 170° C., applying a finish on the yarn, and winding the yarn on a spool for the first time in the process.

BRIEF DESCRIPTION OF THE DRAWING(S)

The invention can be more fully understood from the following detailed description thereof in connection with accompanying drawings described as follows.

DETAILED DESCRIPTION OF THE INVENTION

Figure 1:
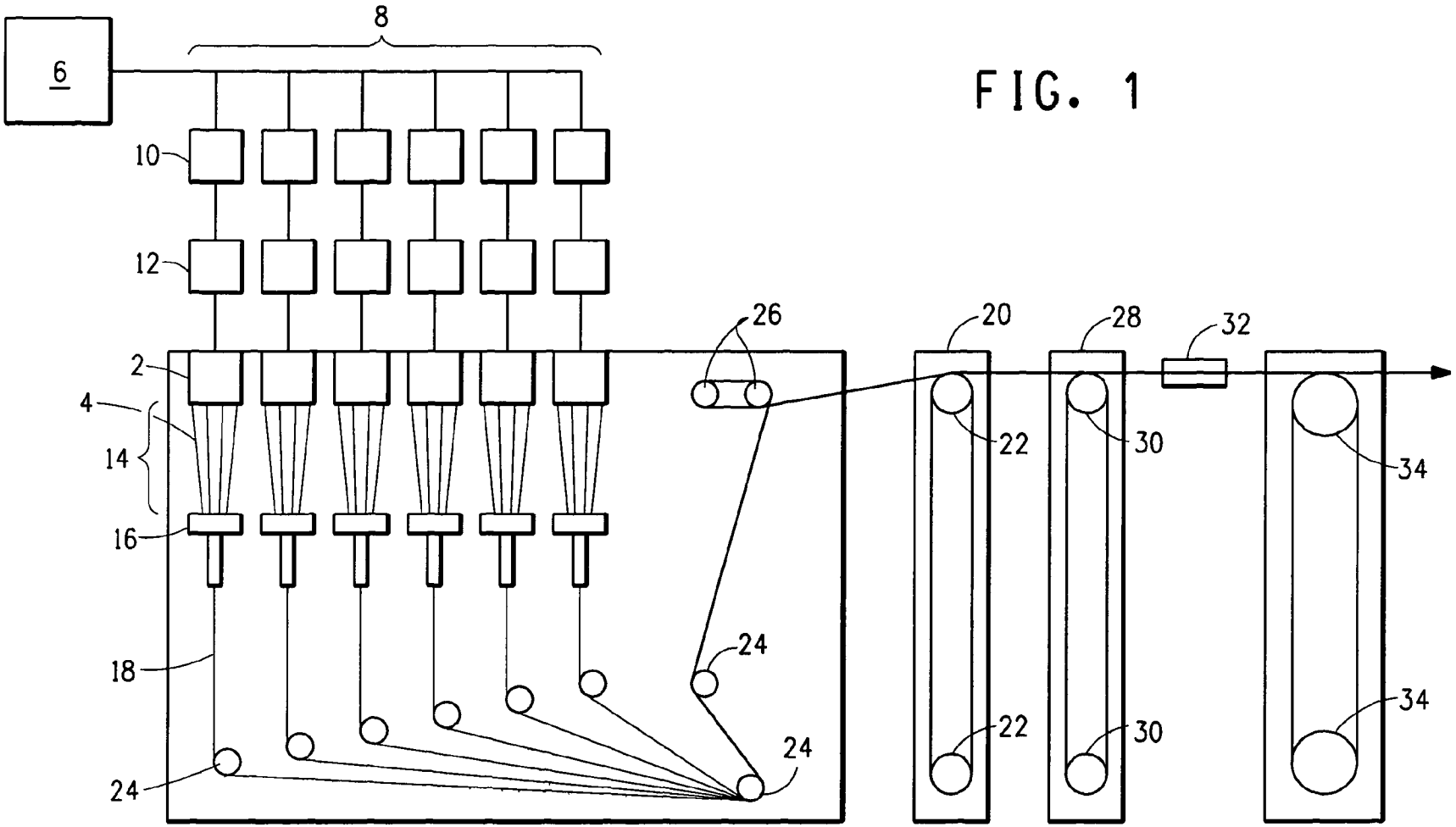
FIG. 1 illustrates apparatus for performing initial steps of a continuous yarn manufacturing process in accordance with the present invention.

This invention is directed to high linear density, high modulus, high tenacity yarns and processes for making such yarns.

Fiber and Yarn

Yarns of the present invention comprise (a) a plurality of fibers having an orientation angle of no more than 8.0 degrees and made of para-aramid having an inherent viscosity of 5.2 to 6.2 dl/g, (b) a linear density of at least 2666 dtex (2400 denier), (c) a modulus of at least 810 grams per dtex (900 grams per denier), and (d) a tenacity of at least 18 grams per dtex (20 grams per denier).

For purposes herein, the term "fiber" is defined as a relatively flexible, macroscopically homogeneous body having a high ratio of length to width across its cross-sectional area perpendicular to its length. The fiber cross section can be any shape, but is typically circular. Herein, the term "filament" is used interchangeably with the term "fiber".

The fibers can be any length. The fibers can be continuous filaments which are filaments that extend typically for a meter or much longer. Filaments are spun in a continuous form frequently as part of a multifilament yarn, wound unto a spool and then cut after the desired amount is placed on the spool. The filaments can be cut into staple fibers having a length of about 0.25 to about 5 inches (about 0.64 cm to about 12.7 cm). The staple fiber can be straight (i.e., non crimped) or crimped to have a saw tooth shaped crimp along its length, with a crimp (or repeating bend) frequency of about 3.5 to about 18 crimps per inch (about 1.4 to about 7.1 crimps per cm).

The fibers have an orientation angle of no more than 8.0 degrees. Preferably, the fibers have an orientation angle of 5.0 to 8.0 degrees. More preferably, the fibers have an orientation angle of 6.0 to 8.0 degrees. Even more preferably, the fibers have an orientation angle of 7.0 to 8.0 degrees.

Preferably, the fibers have an apparent crystallite size at the 110 intensity peak of 70 to 85 Angstroms. More preferably, the fibers have an apparent crystallite size at the 110 intensity peak of 71 to 78 Angstroms.

Preferably, the fibers have an apparent crystallite size at the 200 intensity peak of 54 to 60 Angstroms. More preferably, the fibers have an apparent crystallite size at the 200 intensity peak of 54 to 59 Angstroms.

Preferably, the difference between the apparent crystallite size at the 110 intensity peak and the apparent crystallite size at the 200 intensity peak is at least 15 Angstroms. More preferably, the difference is from 15 to 25 Angstroms.

In one embodiment, the fibers have a crystal perfection index of 55 to 70 percent. Preferably, the fibers have a crystal perfection index of 55 to 65 percent.

In one embodiment, the fibers have a linear density of 1.10 to 2.50 dtex (1.00 to 2.25 denier). Preferably, the fibers have a linear density of 1.10 to 1.67 dtex (1.00 to 1.50 denier). More preferably, the fibers have a linear density of 1.33 to 1.55 dtex (1.20 to 1.40 denier).

The yarns are made of a plurality of the filaments. The filaments in yarns can be substantially parallel in which case the yarns are called tows or the filaments can be intermingled or entangled along the length of the yarn to maintain the unity of the yarn. Yarns can be made by combining two or more sets of fibers or tows. When two or more tows are involved, they can be entangled by an air jet to make them a hold together as a unitary yarn.

The yarn preferably comprises 1100 to 2500 fibers, more preferably 1900 to 2500 fibers and even more preferably 2000 to 2350 fibers.

The yarn has a "high" linear density which for purposes of this invention is defined as a linear density of at least 2666 dtex (2400 denier). The yarn can have a linear density of as much as 3444 dtex (3100 denier) or more. Preferably, the yarn has a linear density of 2777 to 3444 dtex (2500 to 3100 denier). More preferably, the yarn has a linear density of 3000 to 3222 dtex (2700 to 2900 denier).

The yarn has a "high" modulus which for purposes of this invention is defined as a modulus of at least 810 grams per dtex (900 grams per denier). The yarn can have a modulus of as much as 990 grams per dtex (1100 grams per denier) or more. Preferably, the modulus is from 810 to 990 grams per dtex (900 to 1100 grams per denier). More preferably, the modulus is from 846 to 945 grams per dtex (940 to 1050 grams per denier).

The yarn has a "high" tenacity which for purposes of this invention is defined as a tenacity of at least 18 grams per dtex (20 grams per denier). The yarn can have a tenacity of as much as 24.3 grams per dtex (27.0 grams per denier) or more. Preferably, the tenacity is from 18.0 to 24.3 grams per dtex (20.0 to 27.0 grams per denier). More preferably, the tenacity is from 19.8 to 23.4 grams per dtex (22.0 to 26.0 grams per denier).

Polymer

The yarns of the present invention are made of para-aramid having an inherent viscosity of 5.2 to 6.2 dl/g, and preferably an inherent viscosity of 5.4 to 6.0 dl/g.

By the term "para-aramid" is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. Para-aramid, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid. The preferred para-aramid is poly(p-phenylene terephthalamide) homopolymer (PPD-T).

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Process for Making the Yarn

If not already prepared, a first step can be preparing an anisotropic dope or spinning solution comprising dissolving the para-aramid polymer in a solvent. Suitable solvents include strong acids, such as, sulfuric acid, chloro and fluoro sulfonic acids, nitric acid, hydrogen chloride or hydrofluoric acid.

The dope solution should contain a high enough concentration of polymer for the polymer to form an acceptable filament after extrusion and coagulation. The concentration of the para-aramid polymer is preferably at least about 14 weight percent, more preferably at least about 15 weight percent and most preferably at least about 19 weight percent. The maximum concentration is limited primarily by practical factors, such as polymer solubility and dope viscosity. The concentration of polymer is preferably no more than 21 weight percent, and more preferably no more than about 20.5 weight percent.

The polymer dope solution can contain additives such as anti-oxidants, lubricants, ultra-violet screening agents, colorants and the like which are commonly incorporated.

Referring to FIG. 1, the process for making the yarn includes a step of extruding the anisotropic dope solution of the para-aramid polymer in a solvent through a spinneret 2 having a plurality of holes forming a plurality of dope fibers or filaments 4. The polymer anisotropic dope solution is forced from a source 6, though a distribution network 8, such as, by meter pumps 10, through temperature regulating devices 12, through the dies or spinnerets 2 to extrude, spin or make the dope filaments 4. Preferably, the temperature regulating devices 12 control the temperature of the dope solution to be about 65 to 85° C. as it exits the spinnerets 2. Each spinneret 2 contains a plurality of holes. In one embodiment, the spinnerets 2 can contain 600 to 1500 holes, and they may be arranged in circles, grids, or in any other desired arrangement. The spinnerets 2 can be constructed out of ordinary materials that will not be degraded by the dope solution, such as stainless steel.

Dope solution exiting the spinnerets 2 form the dope filaments 4 that enter a gap 14 between the spinneret 2 and a coagulation bath 16. The gap 14 is typically called an "air gap" although it need not contain air. The gap 14 may contain any gas that does not induce coagulation or react adversely with the dope, such as air, nitrogen, argon, helium or carbon dioxide. The dope filaments 4 are passed or drawn across or though the air gap 14, with or without stretching. The draw should be sufficient to provide a filament having the desired diameter.

The process includes passing the dope filaments 4 though the gas gap 14 and then through the coagulating liquid in the bath 16. The filaments 4 are "coagulated" by passing them through the coagulation bath 16 containing a liquid such as water or a mixture of water and the solvent, e.g., sulfuric acid, which removes enough of the solvent to prevent substantial stretching of the filaments 4 during any subsequent processing.

The term "coagulation" as used herein does not necessarily imply that each dope filament 4 is a flowing liquid and changes into a solid phase in the coagulation bath 16. The dope filament 4 can be at a temperature low enough so that it is essentially non-flowing before entering the coagulation bath 16. However, the coagulation bath 16 does ensure or complete the coagulation of the filament, i.e., the conversion of the polymer from a dope solution to a substantially solid polymer filament. The amount of solvent removed when the filaments are passed through the coagulation bath 16 will depend on the residence time of the filaments 4 in the coagulation bath 16, the temperature of the bath 16, and the concentration of solvent therein.

The temperature of the coagulation bath 16 is preferably at least about 3° C., more preferably at least 10° C., and is preferably no greater than 30° C., and more preferably no greater than 20° C. The residence time of the filaments 4 in the coagulation bath 16 is preferably at least 0.015 second, and is preferably no more than 0.100 second. The concentration of acid in the coagulation bath 16 is preferably at least 3 percent by weight, more preferably at least 6 percent, and is preferably no greater than 15 percent and more preferably no greater than 10 percent.

U.S. Pat. Nos. 3,869,429, 4,298,565, 4,340,559 disclose spinning and coagulating structures that are suitable for use in the present invention.

The process includes combining multiple fibers 4 into a multifilament yarn 18 before, during or preferably after passing the filaments 4 through the coagulation bath 16.

Then the process includes washing the coagulated filaments or multifilament yarn 18 with a wash solution in one or more wash step to remove more and most of the solvent from the yarn 18. The washing of the yarn 18 can be carried out by running the yarn 18 through a series of baths and/or through one or more washing cabinets. FIG. 1 depicts one washing bath or cabinet 20. Washing cabinets typically comprise an enclosed cabinet 20 containing a pair of rolls 22 which the filaments travel around a number of times prior to exiting the cabinet 20. As the yarn 18 travels around the rolls 22, it is sprayed with a washing solution. The washing solution is continuously collected in the bottom of the cabinet 22 and drained therefrom.

The yarn 18 is directed by change of direction rolls 24 and driven by motorized feed rolls 26 to pass the yarn 18 from the coagulation bath 16 to the wash cabinet 20.

The temperature of the washing solution is preferably at least 15° C., more preferably at least 50° C., and is preferably no greater than 120° C. and more preferably no greater than 100° C. The washing solution may also be applied in vapor form (steam), but is more conveniently used in liquid form. The residence time of the yarn 18 in the washing bath(s) or cabinet(s) 20 will depend on the desired concentration of residual solvent in the filaments or yarn 18, but typical residence times are in the range of from about 2 seconds to about 20 seconds.

Preferably, the surface of the filaments or yarn 18 is not allowed to dry after passing through the coagulation bath 16 and before the washing step(s) are completed. It is theorized, without intending to be bound, that the wet, "never-dried" surface of the filaments or yarn 18 is relatively porous and provides paths to wash residual solvent from inside the filaments or yarn 18. On the other hand, it is theorized that pores inside the filaments close when they become dry and do not open even when they become wet again. The closed pores, it is believed, trap residual solvent inside the filaments or yarn 18.

The washing step of the present invention can additionally include contacting the coagulated yarn 18 with a neutralization solution (such as in a bath or cabinet 28) containing water and an effective amount of a base under conditions sufficient to neutralize sufficient quantities of the solvent in the yarn 18 to a salt of the base and the acid. Suitable bases that can be used include NaOH, KOH, Ca(OH)2, Mg(OH)2, Sr(OH)2, Na2CO3, NaHCO3, K2CO3, KHCO3, CaCO3, Ca(HCO3)2, CaO, trimethylamine, triethylamine, triethylenediamine, tributylamine, pyridine, or mixtures thereof. Preferably, the base is water soluble. FIG. 1 depicts cabinet 28 containing a pair of rolls 30 which the filaments travel around a number of times prior to exiting the cabinet 28. As the yarn 18 travels around the rolls 30, it is sprayed with a neutralizing solution.

After contacting the yarn 18 with the neutralization solution, the washing step optionally includes the step of contacting the yarn with a washing solution containing water to remove all or substantially all excess base. This washing solution can be sprayed on in the washing bath or cabinet 28 or another washing bath or cabinet.

Then the process includes removing or stripping some of the washing solution from the surface or exterior of the yarn 18, such as, by a dewaterer device 32. The dewaterer can be a device that emits a jet of high velocity air directed at the yarn, or a mechanical water stripper comprising a series of polished ceramic pins arranged such that the pins press lightly against the yarn, to remove excess water. The excess water is generally water on the surface of the yarn. After this removing/stripping step, the moisture content of the yarn 18 is typically no more than about 85 wt % moisture based on the dried yarn.

Then the process includes a first treating step which comprises heating the yarn under tension for a first total heating time. This can be accomplished in one or a plurality of sequential steps.

In the first treating step, the yarn 18 can be heated by a first plurality of steam heated hot rolls 34. The steam heated hot rolls 34 treat the yarn 18 by heating the yarn from 120° C. to 220° C. under a tension of 0.90 to 2.25 grams per dtex (1.00 to 2.50 grams per denier) for a heating time of 1.6 to 5.5 seconds. Preferably, in this first treating step, the yarn is heated from 150° C. to 200° C. under a tension of 0.9 to 2.0 grams per dtex for a heating time of 2.0 to 5.0 seconds. More preferably, in this first treating step, the yarn is heated from 170° C. to 180° C. under a tension of 0.9 to 1.5 grams per dtex for a heating time of 2.5 to 4.0 seconds. The time that the yarn contacts the hot rolls 34 is the heating time. In one embodiment, the first plurality of hot rolls 34 includes at least two steam heated rolls 34 and the yarn contacts the at least two steam heated rolls 34 to remove most of the wash solution from the yarn 18. After exiting these steam heated rolls 34, the yarn typically has a moisture content of no more than 50 wt % moisture content, preferably no more than 40 wt % and more preferably from 20 wt % to 40 wt % moisture content.

This first treatment step stretches the yarn 18 under relatively low tension. This is accomplished by keeping the yarn moisture content relatively high. This reduces the damage to filaments. It is believed that in this step the water in the fibers facilitate the proper alignment of the molecules thereby increasing the modulus of the filaments.

Figure 2:
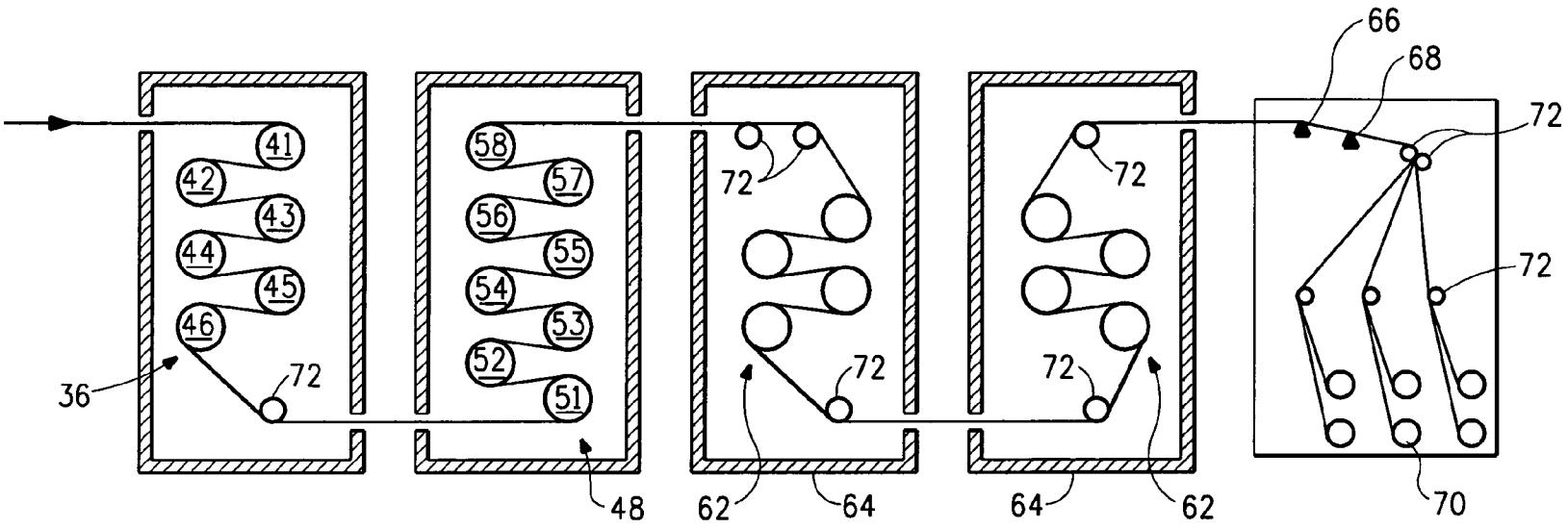
FIG. 2 illustrates a first embodiment of apparatus for performing final steps of the continuous yarn manufacturing process in accordance with the present invention.

In the first treating step, the yarn can optionally be additionally heated by a second plurality of electrically heated hot rolls 36. FIG. 2 illustrates a process where the second plurality of rolls 36 comprises six rolls 41-46. The yarn 18 contacts the at least two steam heated rolls 34 before the yarn 18 contacts the first plurality of electrically heated rolls 36. The electrically heated hot rolls 36 treat the yarn 18 by heating the yarn from 120° C. to 260° C. under a tension of 0.90 to 2.25 grams per dtex (1.00 to 2.50 grams per denier) for a heating time of 0.20 to 0.50 seconds, preferably 0.25 to 0.45 seconds. The rolls 36 can be heated at increasing temperatures from roll 41 to roll 46 or alternatively, the last roll 46 (or the last several rolls) can be heated at progressively higher temperatures to approach the temperature of the next roll in the next or second treatment stage.

The total time that the yarn is treated in the first treating step is the sum of the heating time by contact with the steam heated hot rolls 34 plus the heating time by contact with the electrically heated hot rolls 36. Thus, the total heating time in the first treating step can be from 1.6 seconds to 6.0 seconds. Alternatively, for illustration purposes, the total lowest treating duration in the first treating step can be 1.8 seconds, 2.0 seconds, 2.2 seconds, 2.5 seconds, or 2.7 seconds. Also alternatively, for illustration purposes, the total highest treating duration in the first step can be 5.5 seconds, 5.0 seconds, 4.5 seconds or 4.0 seconds.

The yarn exiting the first plurality of steam heated hot rolls 34 or the first plurality of electrically heated rolls 36 has a yarn moisture content of no more than 50 wt % moisture content, preferably no more than 40 wt % and more preferably from 20 wt % to 40 wt %.

Then the process includes a second treating step of treating the yarn by heating it from 300° C. to 400° C. under a tension of 2.25 to 4.50 grams per dtex (2.50 to 5.00 grams per denier) for a heating time of 0.2 to 5.0 seconds resulting in the high linear density, high modulus, high tenacity yarn. Preferably, in this second treating step, the yarn is heated from 340° C. to 380° C. under a tension of 2.7 to 4.5 grams per dtex (3.0 to 5.0 grams per denier) for a heating time of 0.2 to 4.0 seconds. More preferably, in this second treating step, the yarn is heated from 350° C. to 400° C. under a tension of 2.7 to 4.5 grams per dtex (3.0 to 5.0 grams per denier) for a heating time of 0.3 to 1.0 seconds.

In the second treating step, the yarn can be heated by a second plurality of hot rolls 48. When the yarn 18 is heated by passing the fibers over the second plurality of hot rolls 48, the time the yarn 18 contacts the rolls 48 is the heating time for the second treatment step. In one embodiment, the second plurality of hot rolls 48 comprises eight rolls 51-58 which are electrically heated. The hot rolls 48 do not all have to be heated at the same temperature as long as they are each heated in the specified temperature range.

In the second treatment step, the yarn 18 is heated at a higher temperature to remove moisture content and to crystallize or fix the aligned molecules in place locking the high modulus in the yarn.

Figure 3:
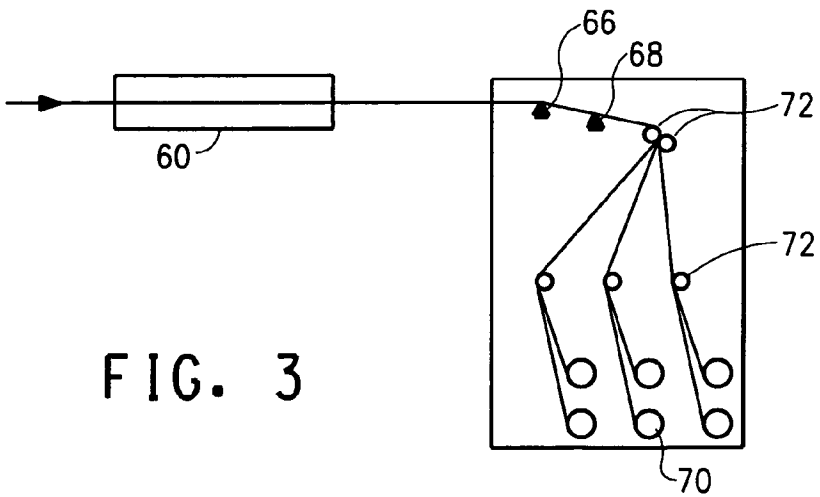
FIG. 3 illustrates a second embodiment of apparatus for performing final steps of the continuous yarn manufacturing process in accordance with the present invention.

In other embodiments, as illustrated in FIG. 3, the yarn 18 can be heated in one or more dryer 60, such as a convention oven, or in one or more section of a dryer that has separate temperature controls, rather than by steam heated rolls 34 and/or rather than by the electrically heated rolls 36, 48. The temperature in the dryer(s) and the dryer residence time is set to provide the same or substantially the same heat and tension treatment to the yarn as specified above. The dryer can be provided with a nitrogen or other non-reactive atmosphere.

Then the process includes a step of cooling the yarn 18 to a temperature of 125 to 170° C. In one embodiment, the yarn is cooled by passing the yarn 18 over a fourth plurality of rolls 62 heated at 125 to 170° C. and the time the yarn contacts the rolls 62 is 0.2 to 4.0 seconds. The fourth plurality of rolls 62 can be steam or electrically heated. They can be positioned in one or more cabinet 64. This cooling step can also be done in an oven, rather than by contacting rolls 62.

Then the process includes a step of applying a finish on the yarn 18. FIGS. 2 and 3 show a finish applicator 66 for this purpose. This step further includes the optional application of water, such as, by a water applicator 68 on the yarn 18 thereby increasing the moisture content preferably to no more than 12 wt % moisture content and more preferably from 4 to 8 wt % moisture content. A purpose of the cooling step is so that the yarn 18 is at a low enough temperature so as not to burn off or harm the finish (including the water) applied to the yarn. The finish can be a lubricant, an emulsifier, water or mixtures thereof. Suitable lubricants include mineral oils, vegetable oils (e.g., triglycerides), and fatty acid esters (e.g., coconut oil, castor oil, polyethylene glycol, etc.). Suitable emulsifiers include fatty acid soaps, fatty amines and glycols. U.S. Pat. Nos. 5,478,648 and 5,674,615 and European patent 0 423 703 A2 disclose suitable finishes for aramid fibers. The finishes are selected to facilitate subsequent processing and use of the yarns.

The process ends by winding the yarn 18 on a spool 70 to form a package for the first time in the process. In this regard, the yarn manufacturing process is a "continuous" process. The yarn 18 stays on-line and continuously moves from formation through the washing step, the removing step, the first and second treating steps, the cooling step, and the applying step before the yarn 18 is wound onto a spool 70. The yarn 18 is not wound up or otherwise taken "off line" for processing elsewhere and then brought back and unwound in order to perform any of the processing steps of the invention.

Rolls (including motorized devices) 72 are suitably positioned to transport the yarn through the process.

INDUSTRIAL APPLICABILITY

High denier, high modulus, high tenacity yarns in accordance with the present invention have many uses. They are particularly useful as reinforcement of fiber optic cables. They are also very useful in oil and gas exploration and processing, in mass transportation applications and in building and construction applications.

Test Methods

The following test methods represent descriptions of methods that can be used to measure parameters used throughout this disclosure and were used in the following Examples.

Temperature is measured in degrees Celsius (° C.).

Linear DensitV can be expressed as denier which is calculated as the weight of a 9000 meter sample in grams. Denier times (10/9) is equal to decitex (dtex). The yarn linear density was measured by weighing a premeasured length of yarn on a Vibroskop 400 Lenzing Instrument obtained from W. Fritzmezger, Inc., of Spartanburg, S.C. 29302 using the ASTM D1907 test method. The filament linear density was determined using the Vibroskop 400 using the ASTM 1577 test method.

Tenacity was determined in accordance with ASTM D 7269 and is the maximum or breaking stress of a fiber as expressed as force per unit cross-sectional area. The tenacity was measured on an Instron model 1130 available from Instron Engineering Corp. of Canton, Mass. and is reported as grams per denier (grams per dtex).

Denier and tenacity tests performed on samples of fibers are at standard temperature and relative humidity conditions prescribed by ASTM methodology. Specifically, standard conditions mean a temperature of 75+/−2° F. (21+/−1° C.) and relative humidity of 55%+/−2%.

Elongation (breaking elongation) was determined in accordance with ASTM D 7269 and is the strain in the sample when it ruptures. The elongation was measured on an Instron model 1130 available from Instron Engineering Corp. of Canton, Mass. and is reported as percent (%).

Modulus was determined in accordance with ASTM D 7269 and is the slope of the tangent line to the initial straight line portion of the stress strain curve, multiplied by 100 and divided by the adhesive-free denier. The modulus is generally recorded at less than 2% strain. The modulus is measured on an Instron model 1130 available from Instron Engineering Corp. of Canton, Mass. and is reported as grams per denier (grams per dtex).

Inherent Viscosity (IV) is defined by the equation:

$$IV=\ln(\eta rel)/c$$

where c is the concentration (0.5 gram of polymer in 100 ml of solvent) of the polymer solution and ηrel (relative viscosity) is the ratio between the flow times of the polymer solution and the solvent as measured at 30° C. in a capillary viscometer. The inherent viscosity values reported and specified herein were determined using concentrated sulfuric acid (96% $H_2SO_4$).

Yarn Moisture is the amount of moisture included in a test yarn determined by removing any finish (such as by washing) and then drying a weighed amount of wet yarn at 160° C. for 1 hour and then dividing the weight of the water removed by the weight of the dry yarn and multiplying by 100.

Crystal Orientation Angle was measured using a Phillips XRG 3100 x-ray generator equipped with a copper x-ray tube. The unit operated at 30 KV and 30 mA. A nickel filter was used in front of a 76.2 mm length collimator, which had a 500 micron inner diameter, thus giving a 500 micron collimated beam at the sample position. Para-aramid fibers, oriented by hand, were held in a parallel aligned set of fibers by a thin collodion coating and mounted at the sample position on a goniometer head. Radiation diffracted from the sample traveled to the detector through a flightpath filled with helium. The flightpath consisted of a conical metallic hollow chamber with apex towards the sample and base at the detector. The apex and base were covered by 1.25 micron Mylar® film windows. A 5 mm beamstop was glued to the Mylar® film window at the center of the detector at the base of the conical chamber. The sample to detector distance was 9 cm. The 2D wire detector was a HiStar model from Bruker having a sensitivity area of 107.8 mm×107.8 mm. Sensitivity and spatial calibrations were performed according to manufacturer's specifications, and these calibrations were used in the application of respective corrections by the data collection software (SAXS for WNT version 3.3 from Bruker). Exposures were a minimum of 1 hour. The resultant data consisted of an array of 1024×1024 pixels containing 16-bit data or better. The data was read into Matlab (version 7.4.0) and routines, based on standard analysis methods, were used to analyze the variation in intensity in the azimuthal direction about the beam center. The orientation angle was derived from four intensity peaks or maximums (two centered about the scattering angle at the 110 Miller Indices and two centered about the scattering angle at the 200 Miller Indices). The full width at half height (FWHH) of each of the four intensity peaks was determined and averaged resulting in the orientation angle reported in Table 4. The method used to measure the FWHH for each peak was to determine the baseline intensity level at the level of the background. This baseline is subtracted from the total intensity at the peaks. The FWHH is then determined to be the difference of the two scattering angles on both sides of the maximum peak at which the intensity is half the maximum. A substantially similar and suitable procedure for determining orientation angle is described in "X-Ray Diffraction Methods in Polymer Science" by Leroy E. Alexander, Wiley Interscience (1969) Chapter 4, p. 264. Orientation angle is measured in degrees.

Crystal perfection index and apparent crystallite size were obtained using a Phillips x-ray diffractometer. A Phillips long fine focus copper x-ray tube, type PW2773, was powered by a Spellman high voltage generator, type DF 60N3, operating at 40 KV and 40 mA. A theta compensating slit was used on the incident beam and a graphite monochromator was used on the diffracted beam. The diffractometer was automated by the use of stepping motors and a microprocessor, and was operated in theta-2theta mode. The detector system comprised a scintillation detector and pulse height analysis discrimination. Para-aramid fibers were wrapped side by side on a sample holder to cover, in a single layer, an area of 12.7 mm×25.4 mm, with the long dimension of this area in the direction of the axis of the fibers. The portion of the holder illuminated by the x-rays was made of quartz single crystal, which prevented production of parasitic diffraction from the holder itself. The wrapped fibers were run in reflection geometry, and were mounted on the instrument such that the fiber axis was normal to the axis of the diffractometer. The diffractometer was fitted with an automatic sample changer. Diffraction pattern data were collected from 6 to 36 degrees in scattering angle in steps of 0.1 degrees. The data were collected for 15 seconds at each point. The data was read into Matlab (version 7.4.0) and routines, based on standard analysis methods, used to derive the crystal perfection index and apparent crystallite size. The data provides an intensity versus scattering angle diffraction pattern consisting of the 110 intensity peak at 20 degrees scattering angle, and the 200 intensity peak at 23 degrees scattering angle.

Crystal perfection index (CPI) was determined by routines in Matlab software using the following formula:

$$CPI=(1-A/B)100$$

where A is the height of the maximum intensity at the 200 peak (minus the background intensity) and B is the minimum intensity between the maximum intensities at the 110 peak and the 200 peak (minus the background intensity). Crystal perfection index is measured in percent.

Apparent crystallite size (ACS) is a measure of the size of the crystals in the direction of the normal to a particular set of crystallographic planes. This is an "apparent" size because it is affected by other factors besides crystallite size, for example crystal perfection. ACS was determined by routines in Matlab software according to the Scherrer formula described in "X-Ray Diffraction Methods in Polymer Science" by Leroy E. Alexander, Wiley Interscience (1969) Chapter 4, p. 264. Apparent Crystallite Size is measured in Angstroms.

EXAMPLES

The following examples are given to illustrate the invention and should not be interpreted as limiting it in any way. All parts and percentages are by weight unless otherwise indicated. Examples prepared according to the process or processes of the current invention are indicated by numerical values. Control or Comparative Examples are indicated by letters.

Four comparison examples A, B, C and D, and two inventive examples 1 and 2 illustrating the invention, were carried out.

In each comparison and inventive example, an anisotropic spinning solution was prepared by dissolving poly-p-phenylene terethalamide homopolymer in 100.1% sulfuric acid so as to produce a 19.5 wt percent solution. The homopolymer had an inherent viscosity of 5.6 dl/g. The spinning solution was extruded through two spinnerets at a spinning solution temperature of 76° C. into an air gap (Dl) followed by a coagulation bath of 7% aqueous sulfuric acid maintained at a coagulation bath temperature of 3° C. in which overflowing bath liquid passed downwardly through an orifice along with the filaments. The spinnerets had a specified number spinning holes of 0.064 mm diameter. The filaments were in contact with the coagulating bath liquid for about 0.025 seconds. The filaments were separated from the coagulating liquid and combined into a single tow bundle or yarn.

Then the yarn was forwarded at a first line speed into and through two washing stages. In the first stage, water having a temperature of 30° C. was sprayed onto the yarns to remove most of the acid. In the second stage, an aqueous solution of sodium hydroxide was sprayed onto the yarns. The yarn was washed by first spraying strong-sodium hydroxide water solution of about 0.2% sodium hydroxide by weight and then spraying the yarn with a weaker sodium hydroxide water solution of 0.02% sodium hydroxide by weight strength. In the second stage, the temperature of the liquid spray was also 30° C. to obtain a slightly basic yarn.

In a first treatment stage, the yarns were partially dried on a pair of steam-heated rolls at a first average temperature (TEMP 1) under a first treatment tension (TENSION 1) for a first roll contact time (TIME 1) resulting in the yarn having a moisture content of at least 30 wt % based on the weight of the dried yarn.

Without further drying, these "wet" or "moist" yarns (called "never dried yarns") were then fed into a second stage. The second stage comprised six hot rolls maintained at an second average temperature (TEMP 2) for a second roll contact time (TIME 2). The fiber was maintained at a second treatment tension (TENSION 2) in this second stage.

The yarn passed from the second stage into a third heat-treatment stage. The third stage comprised eight hot rolls maintained at an third average temperature (TEMP 3) and the yarn contacted these rolls for a third roll contact time (TIME 3) while the yarn was under a third treatment tension (TENSION 3). A Raytek model 4WA67 infrared temperature measuring unit was used to record all roll temperatures.

Then for all examples, except example D, the yarn passed into a fourth treatment stage, a "cooling" stage, comprised of a plurality rolls at 150° C. that reduced the yarn temperature to 150° C. prior to application of finish or subsequent water treatment. In example D, finish was applied before cooling.

The yarn was then passed through finishing and water applicators and finally wound onto a spool into a package. The oil from the finishing applicator provides surface protection and lubrication properties while the water applicator provided 4-8 wt % moisture for yarn stability and static minimization.

Extruding and washing process conditions for all runs are shown in Table 1. Yarn treating process conditions for all runs are shown in Table 2. Cooling and finishing process conditions for all runs are shown in Table 3. Final wound yarn properties for all runs are shown in Table 4.

For each comparative example and each example illustrating the invention, the final yarn properties shown in Table 4 were determined by taking multiple yarn samples from multiple spools of wound yarn. First, the values for the samples from the same spool were averaged. Then the average of these spool averages is reported in Table 4. For example 1, five yarn samples were tested from each of 12 spools. For example 2, five yarn samples were tested from each of 16 spools.

TABLE 1

EXTRUDING AND WASHING PROCESS CONDITIONS

| Example | Polymer Inherent Viscosity (dl/g) | Polymer wt % in Spinning Solution (%) | Spinning Solution Temp (° C.) | D1 - Air Gap (mm) | # of Holes per Spinneret | Diameter of Spinning Holes (mm) | Number of Spinnerets per Yarn | Coag Bath Temp (° C.) | Percent aqueous sulfuric acid for Coagulation Bath (%) | Time in Coag Bath (sec) | Line Speed through Wash (m/min) | Line Speed through Wash (m/min) |
|---|---|---|---|---|---|---|---|---|---|---|---|---|
| A | 5.4-5.6 | 19.5 | 76 | 9.5 | 1333 | 0.064 | 1 | 3 | 7 | 0.023 | 457 | 457 |
| B | 5.4-5.6 | 19.5 | 76 | 5.8 | 1000 | 0.064 | 1 | 3 | 7 | 0.021 | 503 | 503 |
| C | 5.4-5.6 | 19.5 | 76 | 5.8 | 1000 | 0.064 | 1 | 3 | 7 | 0.015 | 686 | 686 |
| D | 5.4-5.6 | 19.5 | 76 | 9.5 | 1333 | 0.064 | 1 | 3 | 7 | 0.024 | 434 | 434 |
| 1 | 5.4-5.6 | 19.5 | 76 | 9.5 | 1000 | 0.064 | 2 | 3 | 7 | 0.025 | 412 | 412 |
| 2 | 5.4-5.6 | 19.5 | 76 | 9.5 | 1000 | 0.064 | 2 | 3 | 7 | 0.025 | 412 | 412 |

TABLE 2

YARN TREATING PROCESS CONDITIONS

| Example | TEMP 1 - Average Temp of Steam Rolls (° C.) | TENSION 1 - Tension at Steam Rolls (g/dtex) | TIME 1 - Contact Time of Steam Rolls (sec) | Moisture Content based on weight after Steam Rolls (%) | TEMP 2 - Average Temp of 6 Hot Rolls (° C.) | TENSION 2 - Tension at 6 Hot Rolls (g/dtex) | Contact Time of 6 Hot Rolls (sec) | Moisture Content based on weight after 6 Hot Rolls (%) | Average Temp of 8 Hot Rolls (° C.) | Tension at 8 Hot Rolls (g/dtex) | Contact Time of 8 Hot Rolls (sec) |
|---|---|---|---|---|---|---|---|---|---|---|---|
| A | 214 | 1.71 | 3.24 | ≦15 | 280 | 2.16 | 0.32 | <15 | 330 | 2.70 | 0.42 |
| B | 216 | 1.80 | 3.30 | ≦15 | 250 | 2.07 | 0.29 | <15 | 315 | 2.34 | 0.38 |
| C | 216 | 1.80 | 2.16 | ≦15 | 250 | 2.07 | 0.21 | <15 | 270 | 2.34 | 0.28 |
| D | 214 | 0.63 | 3.42 | 11 | NA | NA | NA | NA | NA | NA | NA |
| 1 | 180 | 1.35 | 3.60 | ≧30 | 260 | 1.35 | 0.35 | >15 | 330 | 2.88 | 0.47 |
| 2 | 180 | 1.35 | 3.60 | ≧30 | 260 | 1.35 | 0.35 | >15 | 330 | 2.88 | 0.47 |

TABLE 3

COOLING AND FINISHING PROCESS CONDITIONS

| Example | Average Temperature of Cooling Rolls (° C.) | Tension at Cooling Rolls (g/dtex) | Contact Time of Cooling Rolls (sec) | Water weight percent after water applicator (%) |
|---|---|---|---|---|
| A | 150 | 1.5 | 0.42 | 4.0 |
| B | 150 | 1.5 | 0.38 | 4.5 |
| C | 150 | 1.5 | 0.28 | 4.0 |
| D | N/A | N/A | N/A | 11.0 |
| 1 | 150 | 1.5 | 0.47 | 3.5-4.0 |
| 2 | 150 | 1.5 | 0.47 | 3.5-4.0 |

TABLE 4

FINAL YARN PROPERTIES

| Example | Final Fiber Linear Density (dtex/f) | Final Yarn Linear Density (dtex) | Final Yarn Tenacity (g/dtex) | Final Yarn Elongation to Break (%) | Final Yarn Modulus (g/dtex) | Fiber Orientation Angle (degrees) | Fiber Apparent Crystallite Size at 110 Peak (Angstroms) | Fiber Apparent Crystallite Size At 200 Peak (Angstroms) | Fiber Crystal Perfection Index (%) |
|---|---|---|---|---|---|---|---|---|---|
| A | 2.5.0 | 3155 | 19.7 | 2.38 | 796 | 8.2 | 68 | 53 | 54 |
| B | 1.67 | 1578 | 21.7 | 2.45 | 837 | 8.0-10.0 | 55 | 51 | 53 |
| C | 1.67 | 1578 | 20.4 | 2.55 | 765 | 8.0-10.0 | 55 | 51 | 53 |
| D | 2.25 | 3333 | 20.6 | 3.60 | 513 | 16.0 | 46 | 45 | 42 |
| 1 | 1.57 | 3123 | 21.7 | 2.55 | 850 | 7.0 | 73 | 54 | 55 |
| 2 | 1.58 | 3150 | 20.6 | 2.37 | 860 | 7.3 | 76 | 58 | 61 |

In summary, Table 4 shows that only inventive examples 1 and 2 resulted in a yarn have a linear density of at least 2650 dtex and a modulus of at least 810 dtex. Further, Table 4 shows that only inventive examples 1 and 2 resulted in a yarn with fibers having an orientation angle of no more than 8 degrees.

Comparative Example A shows that a yarn was produced with a yarn linear density greater than 3155 dtex with a tenacity of at least 19.7 grams per dtex and an elongation to break of at least 2.38%. However, it did not have a modulus of at least 810 grams per dtex.

Comparative Example B shows that a yarn was produced with a tenacity of at least 21.7 grams per dtex, an elongation to break of at least 2.45% and a modulus of at least 837 grams per dtex. However, it did not have a yarn linear density greater than 1578 dtex.

Comparative Example C shows that a yarn was produced with a tenacity of at least 20.4 grams per dtex and an elongation to break of at least 2.55%. However, it did not have a yarn linear density greater than 1578 dtex or a modulus of at least 810 grams per dtex.

Comparative Example D shows that a yarn was produced, without the treatment or cooling stages, with a yarn linear density greater than 3300 dtex, a tenacity of at least 20.6 grams per dtex and an elongation to break of at least 3.60%. However, it did not have or a modulus of at least 810 grams per dtex.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A yarn, comprising: (a) a plurality of fibers having an orientation angle of no more than 8.0 degrees and made of para-aramid having an inherent viscosity of 5.2 to 6.2 dl/g, (b) a linear density of at least 2666 dtex (2400 denier), (c) a modulus of at least 810 grams per dtex (900 grams per denier), and (d) a tenacity of at least 18 grams per dtex (20 grams per denier).

2. The yarn of claim 1, wherein there are 1100 to 2500 of the plurality of fibers and each of the fibers has a linear density of 1.10 to 2.50 dtex (1.00 to 2.25 denier).

3. The yarn of claim 1, wherein the para-aramid is poly(p-phenylene terephthalamide).

4. The yarn of claim 1, wherein the yarn has a linear density of 2666 to 3444 dtex (2400 to 3100 denier).

5. The yarn of claim 1, wherein the modulus is from 810 to 990 grams per dtex (900 to 1100 grams per denier).

6. The yarn of claim 1, wherein the tenacity is from 18 to 25 grams per dtex (20 to 27 grams per denier).

7. The yarn of claim 1, wherein the orientation angle is 5.0 to 8.0 degrees.

8. The yarn of claim 1, further comprising the fibers having an apparent crystallite size at the 110 intensity peak of 70 to 85 Angstroms.

9. The yarn of claim 1, further comprising the fibers having a crystal perfection index of 55 to 70 percent.

10. A continuous process for making a para-aramid yarn having a linear density of at least 2666 dtex (2400 denier), a modulus of at least 810 grams per dtex (900 grams per denier) and a tenacity of at least 18 grams per dtex (20 grams per denier), comprising:

extruding an anisotropic solution of para-aramid in a solvent-through a spinneret having a plurality of holes forming a plurality of fibers, said fibers having an inherent viscosity of 5.2 to 6.3 dl/g, passing the fibers through a gas and then a coagulating liquid, combining the fibers into a yarn, washing the yarn with a washing solution, removing some of the washing solution from the surface of the yarn, treating the yarn by heating the yarn from 120° C. to 260° C. under a tension of 0.90 to 2.25 grams per dtex (1.00 to 2.50 grams per denier) for a first heating time of 1.6 to 6.0 seconds, and after the first treating step, treating the heated yarn from 300° C. to 400° C. under a tension of 2.25 to 4.50 grams per dtex (2.50 to 5.00 grams per denier) for a second heating time of 0.2 to 5.0 seconds thereby imparting to the yarn fibers an orientation angle of no more then 8.0 degrees, cooling the yarn to a temperature of 125 to 170° C., applying a finish on the yarn, and winding the yarn on a spool for the first time in the process.

11. The process of claim 10, wherein the yarn further having a linear density of 2666 to 3444 dtex (2400 to 3100 denier), the para-aramid having inherent viscosity of 5.4 to 6.0 dl/g, and the fibers having an orientation angle of 5.0 to 7.5 degrees.

12. The process of claim 11, wherein the yarn further comprises the fibers having an apparent crystallite size at the 110 intensity peak of 70 to 85 Angstroms and a crystal perfection index of 55 to 70 percent.

13. The process of claim 10, wherein the para-aramid is poly(p-phenylene terephthalamide).

14. The process of claim 10, wherein in the first treating step, the yarn is heated from 150° C. to 200° C. for the first heating time.

15. The process of claim 10, wherein in the second treating step, the yarn is heated from 340° C. to 380° C. for the second heating time.

16. The process of claim 10, wherein in the first treating step, the yarn is heated in a first oven section or by a first plurality of hot rolls and in the second treating step, the yarn is heated in a second oven section or by a second plurality of hot rolls.

17. The process of claim 10, wherein in the first treating step, the yarn is heated by a first plurality of hot rolls and the time that the yarn contacts the hot rolls is the first heating time.

18. The process of claim 17, wherein the first plurality of hot rolls includes at least two steam heated rolls and the yarn contacts the steam heated rolls to remove most of the wash solution from the yarn.

19. The process of claim 18, wherein the first plurality of hot rolls includes a first plurality of electrically heated rolls and the yarn contacts the at least two steam heated rolls before the yarn contacts the electrically heated rolls.

20. The process of claim 17, wherein in the second treating step, the yarn is heated by passing the wet fibers over a second plurality of hot rolls heated and the time the yarn contacts the rolls is the second heating time.

21. The process of claim 20, wherein the second plurality of hot rolls are electrically heated.

* * * * *